US005753842A

United States Patent [19]

Kitamura

[11] Patent Number: 5,753,842

[45] Date of Patent: May 19, 1998

[54] ELECTRONIC KEYBOARD INSTRUMENT

[75] Inventor: Mineo Kitamura, Hamamatsu, Japan

[73] Assignee: Kabushiki Kaisha Kawai Gakki Seisakusho, Shizuoka-ken, Japan

[21] Appl. No.: 541,825

[22] Filed: Oct. 10, 1995

[30] Foreign Application Priority Data

Oct. 13, 1994 [JP] Japan ..... 6-248062

[51] Int. Cl.[6] ..... G10H 1/00; G10H 1/12; G10H 1/46

[52] U.S. Cl. ..... 84/604; 84/622; 84/633; 84/DIG. 9

[58] Field of Search ..... 84/604–607, 630, 84/633, 622–625, 661, DIG. 9

[56] References Cited

U.S. PATENT DOCUMENTS 4,539,883 9/1985 Chihana ..... 84/1.22
5,198,604 3/1993 Higashi et al. ..... 84/626
5,386,082 1/1995 Higashi ..... 84/630
5,444,180 8/1995 Shioda ..... 84/660
5,478,968 12/1995 Kitagawa et al. ..... 84/626

*Primary Examiner*—William M. Shoop, Jr.
*Assistant Examiner*—Marlon T. Fletcher
*Attorney, Agent, or Firm*—Davis and Bujold

[57] ABSTRACT

An electronic keyboard instrument for reproducing reflected sound generated by an acoustic piano and providing the feeling that sound is reflected and shifted. Left and right system sound signals are generated corresponding to the position of a depressed key on a keyboard. The sound signals are processed through a digital signal processor, a digital-to-analog converter and amplifiers. The processed sound signals are transmitted to left and right loudspeakers. The digital sound processor is composed of filters for extracting predetermined frequency components from each of the sound signals, delay elements for transmitting outputs from the filters with a delay of predetermined time, and adders for adding outputs from the delay elements to the original left and right system sound signals.

12 Claims, 6 Drawing Sheets

ELECTRONIC KEYBOARD INSTRUMENT

FIELD OF THE INVENTION

This invention relates to an electronic keyboard instrument for electrically generating sound in response to the operation of a keyboard.

BACKGROUND OF THE INVENTION

In a known electronic piano, sound waveform is electrically formed corresponding to the position of a depressed key on a keyboard and sound corresponding to the sound waveform is emitted from a loudspeaker.

Conventionally, for such an electronic piano, a pair of left and right loudspeakers are mounted on a front panel or other. Sound is panning processed such that a difference in sound volume is given to sound emitted from the left and right loudspeakers corresponding to the position of the depressed key of the keyboard. Through such a panning process, "directions in sound" can be reproduced, as if the sound were heard emanating directly from a string corresponding to the depressed key in an acoustic piano.

Specifically, when a key arranged toward the right side of the center of the keyboard is depressed, the sound waveform to be transmitted to the right loudspeaker is processed such that its sound volume is louder than that of the waveform to be transmitted to the left loudspeaker. On the other hand, when a key arranged toward the left side of the center of the keyboard is depressed, the sound waveform to be transmitted to the left loudspeaker is processed such that its sound volume is louder than that of the waveform to be transmitted to the right loudspeaker. Simply by generating a single sound waveform and panning processing the waveform, directions in sound can be obtained as in an acoustic piano.

In another proposed conventional electronic piano, sound for each of the left and right loudspeakers is sampled from a performance of an acoustic piano and is stored as PCM waveform data in a memory. The PCM waveform data for left and right systems are read such that sound corresponding to the position of a depressed key on a keyboard is reproduced with the respective loudspeakers. In such an electronic piano, sound almost identical to that of an acoustic piano can be emitted as stereophonic sound from the left and right loudspeakers. Therefore, broadened sounding can be realized as in an acoustic piano.

In the former conventional electronic piano provided with a panning process function, directions in sound, as obtained during a performance on an acoustic piano, can be obtained with a rather simplified structure. In an acoustic piano, a string sound and the sound made from the string sound being reflected inside the piano give an audience sensation that the sound is shifting. Such a sensation cannot be reproduced by the conventional electronic piano.

In the latter conventional electronic piano, a sensation of sound direction and shifting can be reproduced as in an acoustic piano. However, PCM waveform data must be stored for all the keys of the keyboard and also for each of the respective loudspeakers. Therefore, a vast memory capacity is required, thereby raising cost.

SUMMARY OF THE INVENTION

Wherefore, an object of this invention is to provide an electronic keyboard instrument that can produce a sensation of shifting of the sound direction with a simple structure.

Another object is to provide an electronic keyboard instrument that can provide the sensation of sound direction shifting, as in a performance of an acoustic piano, with a simple structure.

These and other objects are attained by the invention by providing an electronic keyboard instrument provided with a keyboard with a plurality of keys arranged thereon, and a plurality of sound emitters provided in parallel arrangement with the keys for emitting sound. The electronic keyboard instrument is also provided with a keyboard operation detector for detecting the position of a depressed key on the keyboard and a sound waveform output unit for forming sound waveforms representing each of tone and volume of the sound to be emitted from each sound emitter corresponding to the position of the depressed key detected by the keyboard operation detector. The electronic keyboard instrument is further provided with a sound waveform synthesizer. A pair of sound waveforms, selected from a plurality of predetermined sound waveforms, are transmitted from the sound waveform output unit to the waveform synthesizer for extracting a predetermined frequency component from one sound waveform in the pair and adding the frequency component to the other sound waveform in the pair with a delay of a predetermined time, and outputting a synthesized waveform to the sound emitters corresponding to the predetermined sound waveforms.

Sound corresponding to one sound waveform transmitted from the sound waveform output unit is therefore emitted from the sound emitter corresponding to the one sound waveform. While sound corresponding to the other sound waveform transmitted from the sound waveform output unit and added with the predetermined frequency component extracted from the one sound waveform with a delay of the predetermined time is emitted from the sound emitter corresponding to the other sound waveform.

In an acoustic piano, when a key is depressed, the sound of a string struck by the depressed key is heard emanating directly from the direction corresponding to the position of the struck string. Subsequently, the sound resulting from the reflection, or echoing of the string sound inside the piano is heard. The reflected sound, heard after the string sound is reflected by the inner wall of the piano, appears to emanate from a location remote from the direct string sound. Moreover, the frequency of the reflected sound is varied relative to the direct sound and the reflected sound is heard with a delay after the direct sound. The reflected sound creates the sensation that the origin of the sound is shifting from a direction emanating directly from the struck string, to a direction emanating from a location remote from the struck string.

In the present electronic keyboard instrument, before a pair of predetermined sound waveforms is transmitted to the two sound emitters, a predetermined frequency component is extracted from one sound waveform and added to the other sound waveform with a delay of a predetermined time. Therefore, sound corresponding to the one waveform is emitted from the sound emitter corresponding to the one waveform. Likewise sound corresponding to the extracted component of the one waveform is emitted from the sound emitter corresponding to the other sound waveform and is heard as the reflected sound of the sound.

The frequency component to be extracted by and the time period of delay set by the sound waveform synthesizer can be set corresponding to the property of reflection in any acoustic piano. Different from the conventional complicated and expensive structure, in which acoustic piano sound is sampled and stored beforehand in a memory, a sensation of sound shifting as in an acoustic piano can be obtained through a simple structure in the present invention.

In the sound waveform synthesizer, after the predetermined frequency component is extracted from the sound waveform, the extracted component is delayed. Alternatively, the predetermined frequency component can be extracted from the sound waveform after the sound waveform is delayed.

The sound waveform synthesizers can be provided not only for a pair of sound waveforms but also for a plurality of pairs of sound waveforms.

In the electronic keyboard instrument, the sound emitters are provided on at least the left and right sides of the center of the keyboard. At least two sound waveform synthesizers are provided for synthesizing sound waveforms for left and right sound emitters, respectively, such that the predetermined frequency component of one sound waveform is added to the other sound waveform with a delay of a predetermined time. The predetermined frequency components extracted by the sound waveform synthesizers and the predetermined time periods of the delay in the sound waveform synthesizers are set to various values.

In an acoustic piano, as shown in FIG. 6A, reflected sound HO1, corresponding to direct sound TO1 generated at the left side of a keyboard K, is heard emanating from the right side of the keyboard K. As shown in FIG. 6B, reflected sound HO2, corresponding to direct sound TO2 generated at the right side of the keyboard K, is heard emanating from the left side of the keyboard K.

To reproduce sound similar to that of an acoustic piano, in the present electronic keyboard instrument, the sound emitters are provided on the left and right sides of the center of the keyboard. The predetermined frequency component extracted from the sound waveform to be transmitted to the left sound emitter is added with a delay of a predetermined time period to the sound waveform to be transmitted to the right sound emitter. The predetermined frequency component extracted from the sound waveform to be transmitted to the right sound emitter is added with a delay of a predetermined time period to the sound waveform to be transmitted to the left sound emitter.

In the invention, simply by providing at least two sound emitters and two sound waveform synthesizers, the sensation of sound shifting can be obtained.

Furthermore, since the sound waveform synthesizers differ from each other in the set values of their respective predetermined frequency components and that delay time periods, the portion of the sound emitted from the left sound waveform that is superimposed on the sound emitted from the right sound emitter has a different property. Therefore, sound similar to that produced by an acoustic piano is emitted.

The sound waveform output unit is provided with a sound waveform generator for generating a pair of sound waveforms corresponding to the position of the depressed key detected by the keyboard operation detector. The sound waveform output unit is also provided with a sound waveform adjuster for adjusting the pair of sound waveforms generated by the sound waveform generator, such that the volume of the sound emitted by the sound emitter provided closest to the detected position of the depressed key is louder than the volume of the sound emitted by the other sound emitter, and for transmitting the adjusted pair of sound waveforms to the sound emitters, respectively.

In the electronic keyboard instrument, simply by forming one sound waveform, sound waveforms representing sound volume corresponding to the position of the depressed key can be transmitted to the sound emitters. In this manner, emitted sound can be heard as if an acoustic piano sound were reflected or shifted with a relatively simple structure.

BRIEF DESCRIPTION OF THE DRAWINGS

The invention will now be described, by way of example, with reference to the drawings, in which.

DETAILED DESCRIPTION OF THE PREFERRED EMBODIMENT

Figure 1:
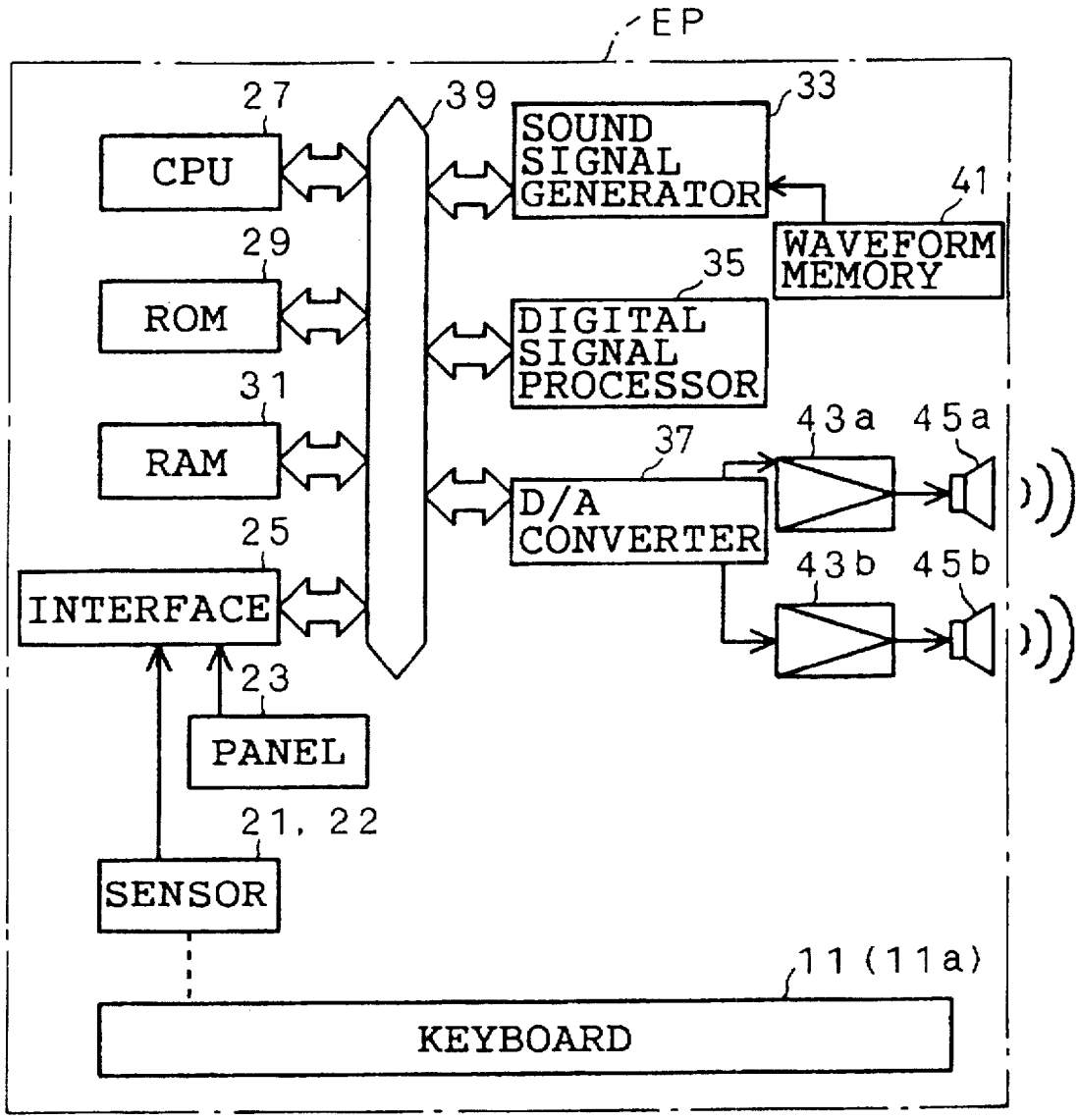
FIG. 1 is a diagrammatic representation showing the structure of an electronic piano embodying the invention.

An electronic piano EP is, as shown in FIG. 1, composed of a keyboard 11 provided with 88 keys 11*a*; key sensors 21,22 for detecting the operation condition of the keys 11*a*; an operation panel 23 provided with a power switch, a mode changeover switch and other various switches; and an interface 25 for receiving signals from the key sensors 21, 22 and the operation panel 23. The electronic piano EP is also composed of CPU 27 for executing various control processes based on the signals entered through the interface 25; ROM 29 for temporarily storing programs for execution of the control processes by CPU 27; RAM 31 for temporarily storing data to be processed by CPU 27; a sound signal generator 33 for generating sound waveform or sound signal for left and right sounding systems according to an instruction given by CPU 27, as hereinafter disclosed in detail; a digital signal processor 35 for processing the sound signal generated by the sound signal generator 33 in the manner hereinafter detailed; and a digital-to-analog converter 37 for converting the two system sound signals transmitted from the digital signal processor 35 into corresponding analog signals for output. The interface 25, CPU 27, ROM 29, RAM 31, the sound signal generator 33, the digital signal processor 35 and the digital-to-analog converter 37 are interconnected through a system bus 39.

The sound signal generator 33 is connected to a waveform memory 41. Monaural sound waveform data, sampled beforehand from an acoustic piano performance, corresponding to each of the keys 11*a* is stored in the waveform memory 41. The two system analog signals transmitted from the digital-to-analog converter 37 are amplified by amplifiers 43*a*, 43*b*, respectively, such that sound is emitted from loudspeakers 45*a*, 45*b*.

The loudspeakers 45*a* and 45*b* are situated at predetermined positions on the left and right sides of the piano EP as seen by a player sitting at the center of the keyboard 11.

Figure 2:
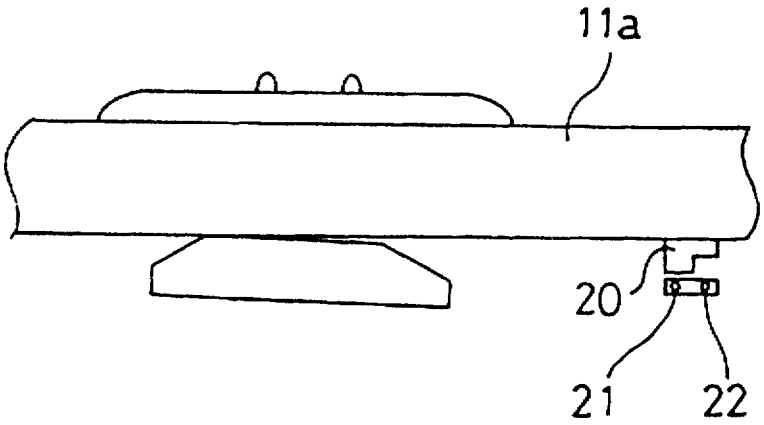
FIG. 2 is an explanatory view showing the structure of key sensors provided on the electronic piano.

The key sensors 21,22 and the associated structure are now explained referring to FIG. 2. As shown in FIG. 2, a stepped shutter 20 and key sensors 21, 22 are provided on the underside of each key 11*a*. The key sensors 21, 22 are each composed of a light emitting element and a light receiving element. When the light path between these elements is interrupted by the stepped shutter 20, an on signal is emitted. When the key 11*a* is depressed, the light paths in the key sensors 21 and 22 are sequentially interrupted by the stepped shutter 20, with the time difference corresponding to the speed at which the key is depressed.

By identifying the key sensors 21, 22 emitting an on signal, CPU 27 detects the keys 11*a* that are currently depressed by the player. The speed of depression of the key or the strength of the key depression corresponding to the sound volume are determined from the difference in time between the on signal transmitted from the key sensor 21 and the on signal transmitted from the key sensor 22.

Figure 3:
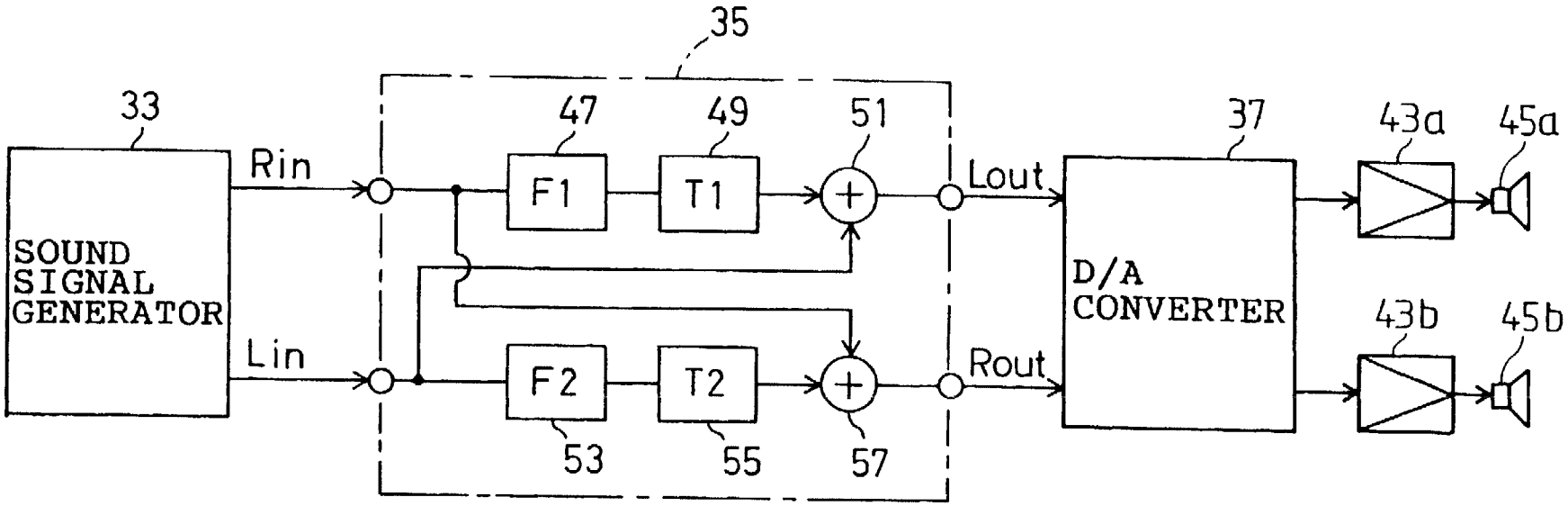
FIG. 3 is a diagrammatic representation showing the structure of a digital signal processor provided on the electronic piano.

The digital signal processor 35 is now explained referring to FIG. 3. On order to process a right system sound signal Rin transmitted from the sound signal generator 33, the digital signal processor 35 is composed of: a filter 47 for passing through only the predetermined frequency component F1 in the right system sound signal Rin; a delay element 49 for transmitting an output signal from the filter 47 with a delay of a predetermined time T1; and an adder 51 for adding an output sielal from the delay element 49 and a left system sound signal Lin transmitted from the sound signal generator 33 to form a sound signal Lout and transmitting the signal Lout to the digital-to-analog converter 37. In order to process a left system sound signal Lin transmitted from the sound signal generator 33, the digital signal processor 35 is provided with: a filter 53 for passing through only the predetermined frequency component F2 of the left system sound signal Lin; a delay element 55 for transmitting an output signal from the filter 53 with a delay of a predetermined time T2; and an adder 57 for adding an output signal from the delay element 55 and the right system sound signal Rin transmitted from the sound signal generator 33 to form a sound signal Rout and transmitting the signal Rout to the digital-to-analog converter 37.

In the embodiment, the filter 47 is a low pass filter for passing through only the component having a frequency of 300 Hz and lower, and the filter 53 is a high pass filter for passing through only the component having a frequency of 500 Hz and higher. The delay time T1 of the delay element 49 is set to 30 ms, and the delay time T2 of the delay element 55 is set to 10 ms. In the embodiment, the filters 47, 53, the delay elements 49, 55 and the adders 51, 57 form a sound waveform synthesizer.

Figure 4:
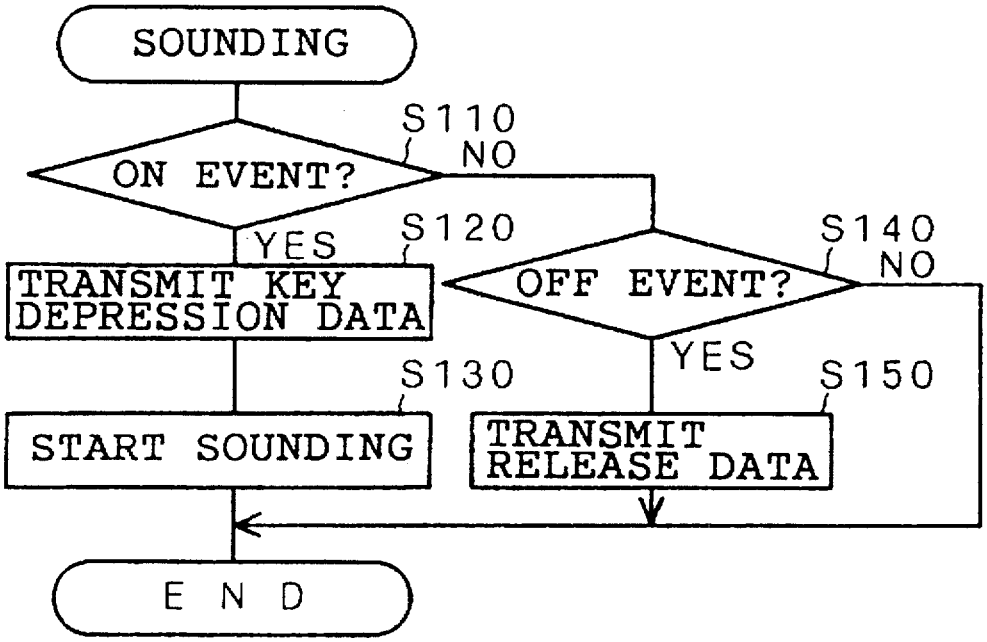
FIG. 4 is a flow chart showing the progress of the sounding process executed by the CPU of the electronic piano.

The operation of the electronic piano EP having the aforementioned structure is now explained with reference to the flowchart of FIG. 4. The sounding process of CPU 27 is repeatedly started and executed at predetermined time intervals after the power switch attached to the operation panel 23 is turned on.

After the sounding process is started, it is determined based on detection signals transmitted from the key sensors 21, 22 at step S110 whether or not a key 11*a* is depressed, i.e., whether or not there is an on event. When there is an on event, at step S120 the key number of the depressed key 11*a* and the depressing strength of the key are determined based on the detection signals and the key depression data representing the key number and the key depressing strength is transmitted to the sound signal generator 33.

The waveform data corresponding to the depressed key number is subsequently read from the waveform memory 41. The sound signal generator 33 then produces the left and right system sound signals having a sound volume corresponding to the key depressing strength. Furthermore, the panning process of the two system sound signals is executed by the sound signal generator 33. In this manner, the sound signal waveforms are formed and adjusted by the sound signal generator 33.

In the panning process executed by the sound signal generator 33, the loudness of the sound volume in the left and right system sound signals is varied corresponding to the key number indicating the position of the depressed key, given by the CPU 27. When the key number indicates that the depressed key is positioned on the right side, as viewed by the player, of the center of the keyboard 11, the sound volume in the right system is set louder than the sound volume in the left system. When the key number indicates that the depressed key is positioned on the left side, the sound volume in the left system is set louder than the sound volume in the right system.

After the two system sound signals are produced by the sound signal generator 33, the two system sound signals Rin and Lin are transmitted by CPU 27 to the digital signal processor 35 at step S130. The sound signals are processed, as described later, through the digital signal processor 35, the digital-to-analog converter 37 and the amplifiers 43*a*, 43*b* such that sounding is executed from the loudspeakers 45*a*, 45*b*.

When it is determined at step S110 that there is no on event, the process goes to step S140 at which it is determined based on the detection signals transmitted from the key sensors 21, 22 whether or not a key 11*a* is released, i.e., whether or not there is an off event. When there is an off event, release data is transmitted to the sound signal generator 33 such that the sounding of the key having the corresponding key number is stopped, thereby ending the process. When the release data is received by the sound signal generator 33, the output of the sound signal corresponding to the key number included in the release data is attenuated in a predetermined manner, such that the sound emission corresponding to the key number is stopped.

When it is determined at step S140 that there is no off event, there is neither an on event nor an off event. Therefore, the sounding process ends without executing any further steps.

The two system sound signals transmitted from the sound signal generator 33 to the digital signal processor 35 are processed in the following manner, such that sound is emitted from the loudspeakers 45*a*, 45*b*.

Turning again to FIG. 3, the frequency component with a frequency of 300 Hz or lower is extracted by the filter 47 from the right system sound signal Rin, and transmitted with a delay of 30 ms by the delay element 49 to the adder 51. In the adder 51, the frequency component transmitted from the delay element 49 and the left system sound signal Lin transmitted the from the sound signal generator 33 are added to form the sound signal Lout, which is in turn transmitted to the digital-to-analog converter 37.

Furthermore, in the digital signal processor 35, the 500 Hz or higher frequency component is extracted from the left system sound signal Lin by the filter 53 and transmitted with a delay of 10 ms by the delay element 55 to the adder 57. In the adder 57 the frequency component transmitted from the delay element 55 and the right system sound signal Rin transmitted from the sound signal generator 33 are added to form the sound signal Rout, which is in turn transmitted to the digital-to-analog converter 37.

The sound signals Lout and Rout transmitted from the digital signal processor 35 are converted by the digital-to-analog converter 37 to analog signals, which are then transmitted to the amplifiers 43*a*, 43*b* for being amplified. Sound corresponding to the amplified analog signals is emitted from the loudspeakers 45*a*, 45*b*.

In the electronic piano EP of the embodiment, the left system sound signal Lin transmitted from the sound signal generator 33 is added with the 300 Hz or lower frequency component of the right system sound signal Rin with a delay of 30 ms. Sound corresponding to the added and formed sound signal Lout is emitted from the left loudspeaker 45*a*. Concurrently, the right system sound signal Rin transmitted from the sound signal generator 33 is added with the 500 Hz or higher frequency component of the left system sound signal Lin with a delay of 10 ms. Sound corresponding to the added and formed sound signal Rout is emitted from the right loudspeaker 45*b*.

In the aforementioned electronic piano EP embodying the invention, although a monaural sound source is used for emitting sound from the left and right loudspeakers 45*a*, 45*b*, the panning process of two system sound signals is executed by the sound signal generator 33. Therefore, for example, when a key arranged on the left side of the center of the keyboard 11 is depressed, the sound emitted from the left loudspeaker 45*a* becomes louder than the sound emitted from the right loudspeaker 45*b*. Consequently, sound directed from the electronic piano can be heard as in an acoustic piano performance.

Furthermore, in the electronic piano of the embodiment, sound corresponding to the sound signal Lout is emitted from the left loudspeaker 45*a*. The sound signal Lout is formed by adding the 300 Hz or lower frequency component of the right system sound signal Rin to the original left system sound signal Lin transmitted from the sound signal generator 33 with a delay of 30 ms. Sound corresponding to the sound signal Rout is emitted from the right loudspeaker 45*b*. The sound signal Rout is formed by adding the 500 Hz or higher frequency component of the left system sound signal Lin to the original right system sound signal Rin transmitted from the sound signal generator 33 with a delay of 10 ms.

Therefore, when a key arranged on the left side of the center of the keyboard 11 is depressed, the sound that is emitted from the right loudspeaker 45*b* is heard as reflected sound of the sound emitted loudly from the left loudspeaker 45*a*. When a key arranged on the right side of the center of the keyboard 11 is depressed, the sound that is emitted from the left loudspeaker 45*a* is heard as reflected sound of the sound emitted loudly from the right loudspeaker 45*b*.

In the electronic piano EP of the embodiment, a sound shifting sensation can be obtained as in an acoustic piano performance, without requiring the complicated and expensive structure in which acoustic piano sound is sampled and stored for a plurality of loudspeakers.

In the digital signal processor 35 of the embodiment, the sound signals Rin, Lin transmitted from the sound signal generator 33 are transmitted through the filters 47, 53 to the delay elements 49, 55. The positions of the filters and the delay elements can be reversed.

In the embodiment, the filter 47 is a low pass filter of 300 Hz or lower frequency and the filter 53 is a high pass filter of 500 Hz or higher frequency. The filtering property of the filters 47, 53 can be set as required. Also, the delay time of the delay elements 49, 55 can be set as required.

Further in the embodiment, the waveform data for each of the keys 11*a* is stored beforehand in the waveform memory 41. The pair of sound signals are generated by the sound signal generator 33 using the waveform data. Alternatively, the sound signal can be generated directly without using the waveform data.

In the embodiment, two system sound signals are formed by the sound signal generator 33, by pan processing a monaural sound. Alternatively, two stereophonic sound signals with different tones can be used by appropriately setting the property of the filters 47, 53 and the delay elements 49, 55 in the digital signal processor 35, thereby providing stereophonic sound similar to an acoustic piano sound.

In the embodiment two loudspeakers are provided. The number of loudspeakers can be increased as required.

For example, when another loudspeaker is added in the middle, i.e. centered between left and right loudspeakers 45*a*, 45*b*, the sound signal generator 33 can be adapted to generate three system sound signals corresponding to the respective loudspeakers. In order to process three sound signals, the digital signal processor 35 can be provided with a structure Dsp, as shown in FIG. 5.

Six combinations of the three system sound signals: left system sound signal Lin; middle system sound signal Cin; and right system sound signal Rin are Lin+Rin, Lin+Cin, Cin+Lin, Cin+Rin, Rin+Cin and Rin+Lin. For the six combinations, filters 59*a* to 59*f* and delay elements 61*a* to 61*f* are provided, respectively. Each sound signal is added with the predetermined frequency component extracted from the other two sound signals with predetermined time delays in adders 63*a*, 63*b* and 63*c*.

Also in this structure, by appropriately setting the filtering properties FL1, FL2, FC1, FC2, FR1 and FR2 of the filters 59*a* to 59*f* and delay time TL1, TL2, TC1, TC2, TR1 and TR2 of the delay elements 61*a* to 61*f*, sound direction shifting feeling can be obtained as in an acoustic piano performance.

Figure 5:
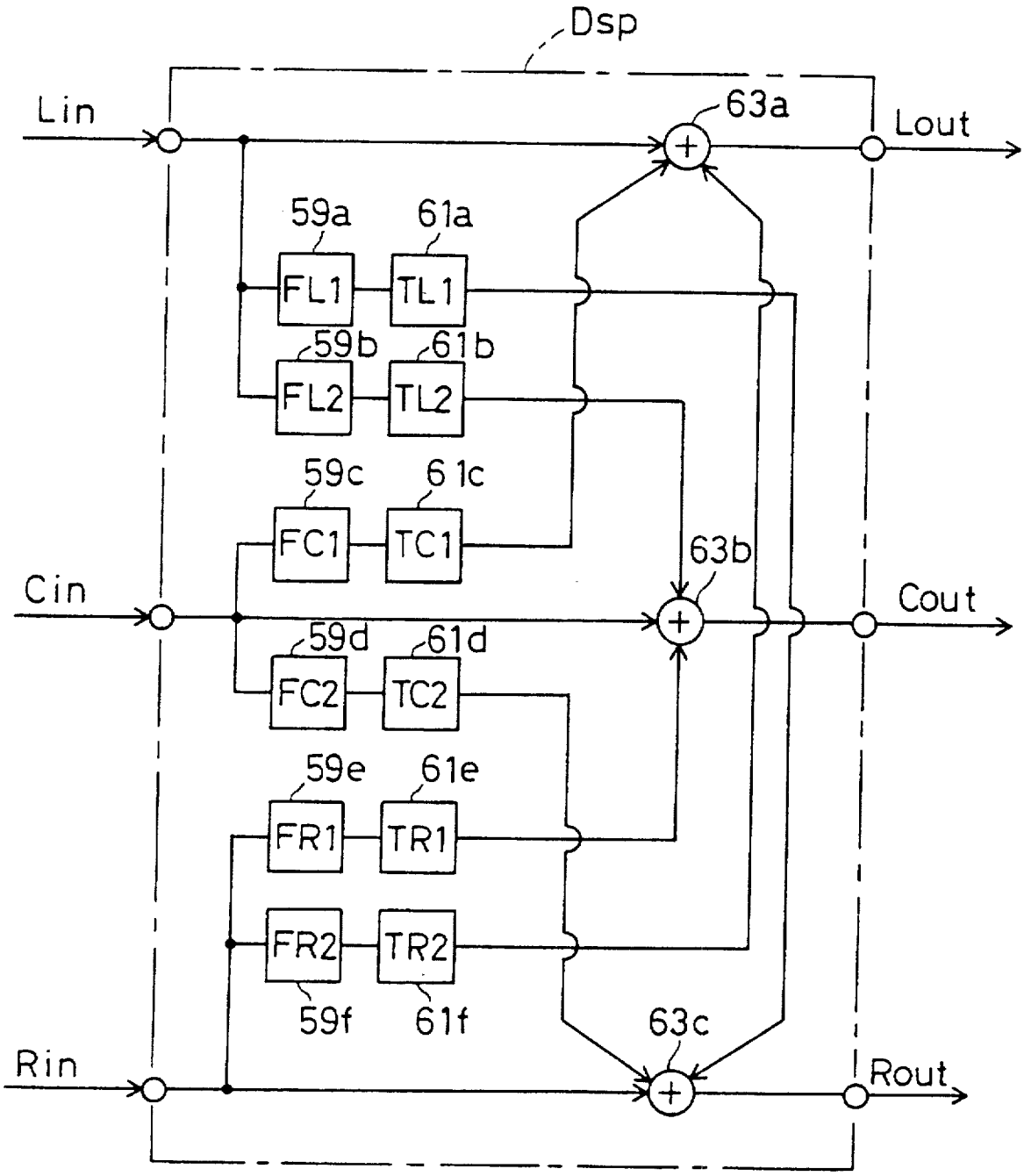
FIG. 5 is a diagrammatic representation showing the structure of another digital signal processor.
Figure 6A:
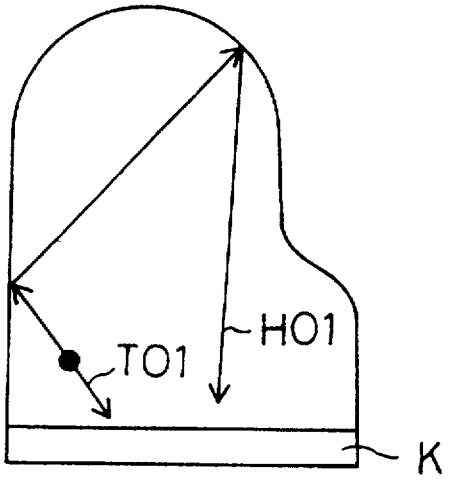
FIGS. 6A and 6B are explanatory views showing reflected sound generated by an acoustic piano.
Figure 6B:
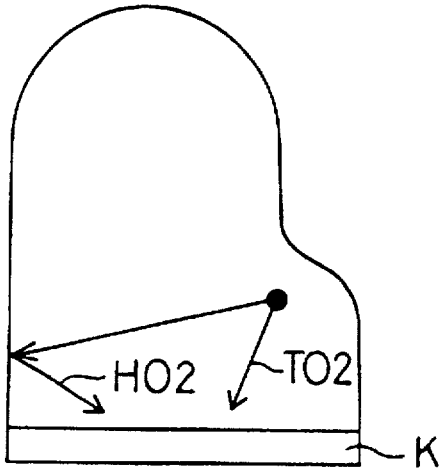

In the digital signal processor Dsp shown in FIG. 5, either filter or delay element can be selectively removed from the filters 59*a* to 59*f* and the delay elements 61*a* to 61*f*.

This invention has been described above with reference to the preferred embodiment as shown in the figures. Modifications and alterations may become apparent to one skilled in the art upon reading and understanding the specification. Despite the use of the embodiment for illustration purposes, the invention is intended to include all such modifications and alterations within the spirit and scope of the appended claims.

What is claimed is:

1. A method of producing sound in an electronic keyboard instrument comprising the steps of:

providing a keyboard having a plurality of keys arranged in at least one row thereon;

detecting a position of each said depressed key on said keyboard and a speed of depression of each said depressed key;

generating center, left and right sound waveforms representing sound having a tone and a volume corresponding to the detected position and speed of depression of each said depressed key;

extracting a predetermined first frequency component from the right sound waveform transmitted from a sound waveform output means, delaying the first frequency component by a predetermined first time period and adding the delayed first frequency component to a delayed frequency component from the center sound waveform, delayed by a predetermined third time period, and the left sound waveform thereby producing a left synthesized waveform;

extracting a predetermined second frequency component from the left sound waveform transmitted from said sound waveform output means, delaying the second frequency component by a predetermined second time period and adding the delayed second frequency component to a delayed frequency component from the center sound waveform, delayed by a predetermined sixth time period, and the right sound waveform thereby producing a right synthesized waveform;

extracting a predetermined third frequency component from the center sound waveform transmitted from said sound waveform output means, and adding said third frequency component with a delayed frequency component from the right sound waveform, delayed by a predetermined fourth time period, and a delayed frequency component from the left sound waveform, delayed by a pre determined fifth time period thereby producing a center synthesized waveform; and generating left, center, and right sound corresponding to said center, said left and said right synthesized waveforms, respectively.

2. An electronic keyboard instrument comprising:

a keyboard having a plurality of keys arranged in at least one row thereon;

keyboard operation detecting means coupled to each of said plurality of keys, for detecting directly, upon depression of any said keys, a position of each said depressed key on said keyboard and a speed of depression of each said depressed key;

sound waveform output means, coupled to each of said detecting means, for generating a plurality of sound waveforms representing sound having a tone and a volume corresponding to the detected position and the detected speed of depression of each said depressed key;

sound waveform synthesizing means, said synthesizing means being coupled to said sound waveform output means, wherein a first predetermined frequency component is extracted from a first waveform, said extracted frequency component is transmitted with a first time delay and combined with a second sound waveform and a delayed third sound waveform to form a left output sound signal;

a second predetermined frequency component is extracted from said a second waveform, said second extracted frequency component is transmitted with a second time delay and combined with said first waveform and a delayed third sound waveform to form a right output sound signal;

a third predetermined frequency component is extracted from a third waveform, said third extracted frequency component is combined with a delayed first sound waveform and a delayed second sound waveform to form a center output sound signal; and three sound emitters are coupled to said synthesizing means and are arranged in a row substantially parallel to the at least one row of said keys, and one of said three sound emitters corresponding with a respective one of said plurality of waveforms for emitting sound corresponding to said plurality of synthesized waveforms.

3. An electronic keyboard instrument comprising:

a keyboard having a plurality of keys arranged in at least one row thereon;

keyboard operation detecting means comprising two key sensors each having a light emitting element and a light receiving element and a stepped shutter, said detecting means being coupled to each of said plurality of keys, for detecting directly, upon depression of any said keys, a position of each said depressed key on said keyboard and a speed of depression of each said depressed key;

sound waveform output means, being coupled to each of said detecting means, for generating a right system sound signal, a left system sound signal and a middle system sound signal, representing sound having a tone and a volume corresponding to the detected position and the detected speed of depression of each said depressed key;

sound waveform synthesizing means comprising a plurality of filters, a plurality of delay elements and a plurality of adders, and said synthesizing means being coupled to said output means, wherein a first filter extracts a first predetermined frequency component from said right system sound signal, said extracted frequency component is transmitted with a first time delay by a first delay element to a first adder, and said first adder combines (i) said extracted frequency component from said right system sound signal with said first time delay, (ii) said left system sound signal and (iii) said center system sound signal with a third time delay to form a left output sound signal;

a second filter extracts a second predetermined frequency component from said left system sound signal, said second extracted frequency component is transmitted with a second time delay by a second delay element to a second adder, and said second adder combines (i) said extracted frequency component from said left system sound signal with said second time delay, (ii) said right system sound signal and (iii) said center system sound signal with a sixth time delay to form a right output sound signal;

a third filter extracts a third predetermined frequency component from said center system sound signal, said third extracted frequency component is transmitted to a third adder, and said third adder combines (i) said extracted frequency component from said center system sound signal, (ii) said right system sound signal with a fourth time delay and (iii) said left system sound signal with a fifth time delay to form a center output sound signal; and at least three sound emitters are coupled to said synthesizing means, a left sound emitter is arranged to the left of a center of the row of said keys, a right sound emitter is arranged to the right of the center of the row of said keys and a center sound emitter is arranged to the center of the row of said keys, for emitting sound corresponding to the left, the right and the center sound waveform data, respectively.

4. An electronic keyboard instrument according to claim 3, wherein said sound waveform output means comprises:

sound waveform generating means for generating said first, second and third sound waveforms with a tone corresponding to the detected position and a volume corresponding to the detected speed of depression of each said depressed key; and sound waveform adjusting means for adjusting the volume of said first, second and third sound waveforms generated by the sound waveform generating means, such that a volume of the sound emitted by a said sound emitter located closest to said detected position of the depressed key is louder than a volume of the sound emitted by a said sound emitter farthest from said detected position, and providing said first, second and third waveforms generated by said generating means with a sound volume corresponding to the detected position of depression of said depressed key.

5. An electronic keyboard instrument according to claim 4, further comprising:

waveform memory means, coupled to said sound waveform output means, for storing prerecorded monaural sound data comprising a plurality of single monaural sound waveforms, one representing each sound produced by individual strings of an acoustic piano; and said output means reads a single monaural waveform corresponding to each said depressed key from said memory means and generates and adjusts said first, second and third waveforms from each said single monaural waveform read from said memory means.

6. An electronic keyboard instrument according to claim 3, wherein said sound waveform synthesizing means includes a left waveform synthesizing means for synthesizing the left waveform, a center sound waveform synthesizing means for synthesizing a right waveform and a right waveform synthesizing means for synthesizing the right waveform, and each said synthesizing means comprising:

a filter for extracting a corresponding said frequency component from a corresponding one of the left, the center and the right waveforms, by permitting only said corresponding frequency component to pass through said filter;

a delay element for delaying said corresponding frequency component by a corresponding time period;

and an adding element, coupled to the other two said synthesizing means for adding a said frequency component extracted from the other of said left, center and right waveforms and delayed by said other two synthesizing means thereby to produce a corresponding said synthesized waveform.

7. An electronic keyboard instrument according to claim 6, wherein the center sound emitter is located midway between said left and right sound emitters.

8. An electronic keyboard instrument according to claim 7, wherein each of said center, said right and said left sound waveform synthesizing means comprises:

two said filters, for extracting two said corresponding frequency components from a corresponding waveform, one for each of the other two waveforms;

two said delay elements, one for delaying each of said two extracted frequency components by a corresponding time period;

and an adding element, coupled to each of the other two said synthesizing means, for adding all corresponding frequency components extracted from each of the other two of said waveforms and delayed by said other two synthesizing means thereby to produce a corresponding said synthesized waveform.

9. An electronic keyboard instrument according to claim 3, wherein said first predetermined frequency component has a frequency of at least about 500 Hz, the first time period is 10 ms, the second frequency component has a maximum frequency of about 300 Hz, the second time period is 30 ms.

10. An electronic keyboard instrument according to claim 6, wherein in the left waveform synthesizing means, a left said filter permits only frequencies of at least about 500 Hz to pass through, and a left said delay element delays a left said frequency component by a time period of 10 ms; and in the right waveform synthesizing means, a right said filter permits only a maximum frequency of about 300 Hz to pass through, and a right said delay element delays a right said frequency component by a time period of 30 ms.

11. An electronic keyboard instrument according to claim 6, wherein a plurality of said sound emitters are arranged in a row substantially parallel to the at least one row of said keys;

said sound waveform output means generates a plurality of said sound waveforms, one for each of said sound emitters, representing sound having a tone and a volume corresponding to the detected position and the detected speed of depression of each said depressed key; and a plurality of said sound synthesizing means, one for each said sound waveform, for producing a corresponding said synthesized waveform.

12. An electronic keyboard instrument according to claim 11, wherein each said synthesizing means comprising:

a plurality of said filters, one said filter for each other sound waveform, for extracting a plurality of frequency components from a corresponding waveform;

a plurality of said delay elements, one said delay element for delaying each of said plurality of extracted frequency components by a corresponding said time period;

and an adding element, coupled to each of the other said synthesizing means, for adding all corresponding frequency components extracted from each of the other of said waveforms and delayed by each said other synthesizing means thereby to produce a corresponding said synthesized waveform.

* * * * *